US006116724A

United States Patent [19]

Bursese

[11] Patent Number: 6,116,724

[45] Date of Patent: Sep. 12, 2000

[54] RE-LOADING DEVICE FOR INK-JET WRITING HEAD

[75] Inventor: Silvio Bursese, Concorezzo, Italy

[73] Assignee: B.M.S. Costruzione Stampi s.r.l., Milan, Italy

[21] Appl. No.: 09/194,882

[22] PCT Filed: Jun. 4, 1997

[86] PCT No.: PCT/EP97/02905

§ 371 Date: Dec. 4, 1998

§ 102(e) Date: Dec. 4, 1998

[87] PCT Pub. No.: WO97/47475

PCT Pub. Date: Dec. 18, 1997

[30] Foreign Application Priority Data

Jun. 7, 1996 [IT] Italy ..... MI96A1170

[51] Int. Cl.[7] ..... B41J 2/175

[52] U.S. Cl. ..... 347/85

[58] Field of Search ..... 347/84, 85, 86, 347/87; 141/18, 2, 329, 375; 53/468; 81/3.39

[56] References Cited

U.S. PATENT DOCUMENTS

| | | | |
|---|---|---|---|
| 5,199,470 | 4/1993 | Goldman . | |
| 5,546,830 | 8/1996 | Yuen | 81/3.39 |
| 5,845,682 | 12/1998 | Hayao | 141/18 |
| 5,906,143 | 5/1999 | Yuen | 81/3.39 |
| 6,053,604 | 4/2000 | Sato et al. | 347/85 |

*Primary Examiner*—N. Le
*Assistant Examiner*—Judy Nguyen
*Attorney, Agent, or Firm*—Hedman, Gibson & Costigan

[57] ABSTRACT

The invention consists of a re-loading device for ink-jet writing head, particularly for three-color ink-jet writing head, which includes a mechanical device (which removes from the body (11) of the ink-jet writing head the original cover used by the producer) and a substitute cover (10) which is connected in a reversible manner to the body of the ink-jet writing head in place of the original cover, where the substitute cover (10) has the same size and shape as the original one and includes at least one tank (3) which contains the ink to be transferred into a tank positioned inside the body (11) of the ink-jet writing head.

10 Claims, 5 Drawing Sheets

RE-LOADING DEVICE FOR INK-JET WRITING HEAD

FIELD OF THE INVENTION

The invention consists of a re-loading device for ink-jet writing head, particularly suitable for re-loading a three-colour ink-jet writing head, often used in the printers constituting one of the most widespread and common interface means with the user. The re-loading device includes a mechanical device for removing from the body of an ink-jet writing head the original cover used by the producer and a substitute cover which is connected to the body of the ink-jet writing head in place of the original cover, where the substitute cover has the same size and shape as the original one and includes at least one tank containing the ink to be transferred into a tank positioned inside the body of the ink-jet writing head.

PRIOR ART

The printers constitute one of the most widespread and common terminals, which can be advantageously used in many technical fields, for instance:

- telecommunication systems, wherein said printers can operate either alone (telex, fax, etc.), or combined with a complex telecommunication system, said printers constituting one of the outlet means;
- data processing systems with any dimension and power (from pocket or desk calculator to personal computer, to a computerised data-processing centre of a large company, and so on), wherein said printers constitute one of the most widespread interface means with the user, when they are not the only available interface means.

There are on the market many well-known different printers which can be classified according to many features, e.g. the writing head, which in its turn can be classified according to the printing system used (impact head, ink-jet head, thermal head etc.); further details and/or classification of the printers and/or writing heads will be omitted in the present specification because they are not pertinent to the present invention.

For the same reason, in the present specification only ink-jet writing heads (and, in particular, three-colour ink-jet writing heads) will be discussed, omitting the other functional unities which constitute a printer.

Some three-colour ink-jet writing heads includes a fourth tank containing a black ink.

A multicolour ink-jet writing head comprises at least three tanks, each of which contains an ink of different colour (green, red, blue and black, if any) and printing means driven by the logical unit of the printer, which in turn may be drived by an upper logical unit, if any; said printing means takes each of said inks from the relevant tank for jetting ink micro drops on a backing (normally but not necessarily of paper) in order to realise the written and/or graphical text as requested.

An ink-jet writing head (and, in particular, a multicolour ink-jet writing head) is expensive because the printing means is realised through advanced constructive processes and by using materials having particular physical and chemical features carefully checked.

Although the producers define this ink-jet writing head as a "disposable" one, it will be apparent that it is uneconomical to replace and to expel a working ink-jet writing head only because one or more of the inks loaded by the producer into the tanks of the ink-jet writing head are exhausted.

The producers widely demonstrated that, utilising inks appropriately designed for said particular use, it is possible to extend the useful life of an ink-jet writing head beyond the exhaustion of the original ink charge.

There are present on the market many re-loading devices developed by the producers of printing fittings which allow re-loading once or more times a one-colour or a multicolour ink-jet writing head. The entrance to a tank which is inside the ink-jet writing head can be obtained either by removal of the means, if any, used by the producer for closing the hole used for the first loading of the relevant ink (green, red, blue or black), or by realising a proper hole on the ink-jet writing head covering.

Re-loading devices consisting of coverings (simple syringes, rubber syringes, bellows syringes, etc.) containing an ink, providing different shapes and/or dimensions and being of a low ergonomic level are known, for example, from U.S. Pat. No. 5,199,470; therefore, the user must perform a sequence of operations which are not always easy and safe, particularly with respect to the risk of an uncontrolled ink leakage from the writing head after the complete ink re-loading of the relevant tank (not completely empty before the re-loading operation and/or having a volume smaller than the loader one).

Ink re-loaders for ink-jet writing heads which allow the gradual and controlled supply of at least part of the ink contained in said re-loader, obviating the aforementioned disadvantages of the above mentioned re-loaders, are known in the art. U.S. Pat. No. 5,408,256 discloses an ink-jet writing head suitable to be re-loaded by removing from its body the original cover using mechanical device, by re-loading in a known way the tanks positioned inside the body of the writing head and by putting back the original cover or a substitute cover.

EP-A-594,055 discloses a cover for ink-jet writing head which includes a lot of holes, each of which corresponds to one of the holes provided in the body of the writing head for the first loading of the tanks positioned inside the body of the writing head: the holes provided on said cover facilitate the insertion of the re-loading means used for re-loading in a known way the tanks positioned inside the body of the writing head.

Said ink re-loaders (having an easy construction, being cheap, preferably realised in a recyclable plastic material and lacking in metal parts) are perfectly suitable for ink-jet writing heads, being expressly designed and realised for the re-loading of said head.

The re-loading device object of the present invention constitutes an improvement of the already known ink re-loaders, since it allows a further reduction of the manual ability required to fill an ink-jet writing head, further reducing the risk, already very reduced, of accidental ink leakages and allowing the reloading (and then the re-use) of ink-jet writing heads which are rechargeable in a difficult way by means of the known re-loaders, e.g. ink-jet writing heads having rigid tanks and compensation systems of the inner pressure, and those which provide one or more tanks in foam material balanced with the environment.

SUMMARY OF THE INVENTION

Object of the present invention is a re-loading device for ink-jet writing head which comprises a mechanical device for removing from the body of the ink-jet writing head the original cover used by the producer and a substitute cover which is connected to the body of the ink-jet writing head in place of the original cover.

The mechanical device comprises a base suitable for receiving at least a part of the ink-jet writing head and a leverage "pivotally" connected to the base and acting on the connection zone between the original cover and the body of the ink-jet writing head at least partially positioned into the base.

The substitute cover has the same size and shape as the original cover and includes:

an external shell having the same size and shape as the original cover;

at least one tank, positioned inside the external shell, containing an ink to be transferred into at least one tank positioned inside the body of the ink-jet writing head;

transfer means for transferring the ink from the at least one tank positioned inside the external shell to the at least one tank positioned inside the body of the ink-jet writing head;

reversible means connecting the substitute cover to the body of the ink-jet writing head, the substitute cover being manually separable from the body of the ink-jet writing head when at least one of its tanks is empty.

LIST OF THE ENCLOSED DRAWINGS

The invention will be better understood with reference to an embodiment, suitable for re-loading a three-colour ink-jet writing head, shown in the enclosed drawings, where:

In the enclosed figures the correspondent structural elements are marked with the same numerical references.

DETAILED DESCRIPTION OF THE INVENTION

A re-loading device for ink-jet writing head, realised according to the invention, includes a mechanical device (FIGS. 12 and 13) for removing from the body 11 (FIG. 1) of an ink-jet writing head the original cover used by the producer and a substitute cover 10 (FIG. 1) suitable to be connected to the body 11 of the ink-jet writing head in place of the original cover.

Figure 1:
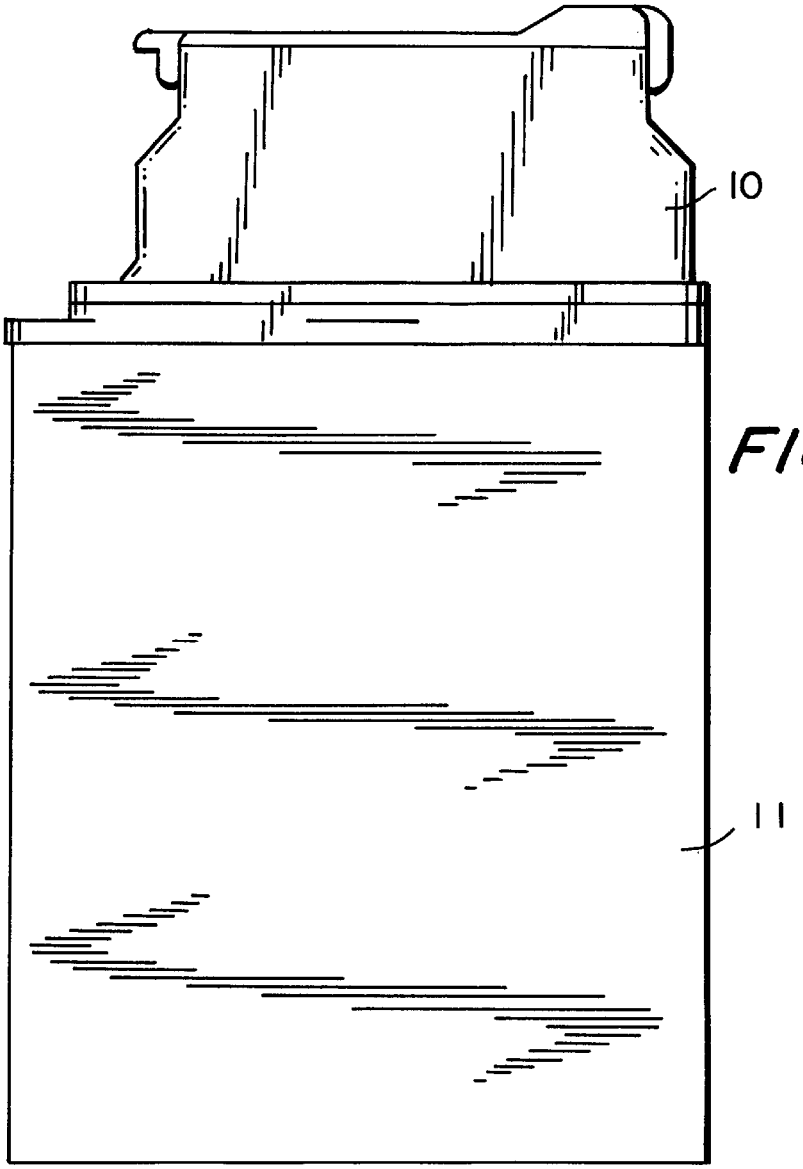
FIG. 1 shows schematically a side view of a substitute cover realised according to the invention connected to the body of a threecolour ink-jet writing head.
Figure 2:
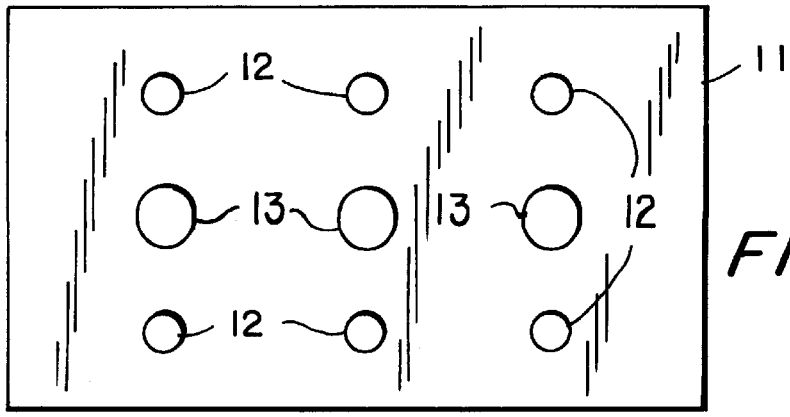
FIG. 2 shows a top view of the upper side of the body of the three-colour ink-jet writing head of FIG. 1.

FIG. 1 shows schematically the substitute cover 10 connected to the body 11 of a three-colour ink-jet writing head, which is not described in greater detail: as shown in the top view of FIG. 2, the upper side of the body 11 is provided with three groups of three holes (12, 13), where at least some of the lateral ones (12) are used for connecting the original cover to the body 11, while the central ones (13) are used for the first loading of each ink into the relevant tank of the three-colour ink-jet writing head.

Figure 9:
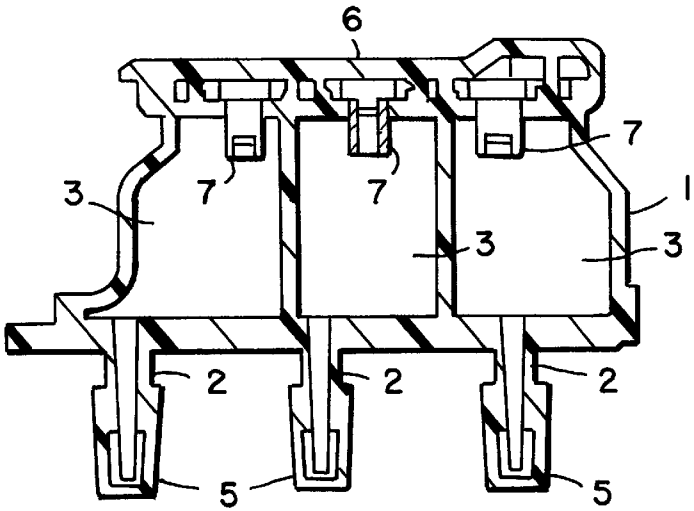
FIG. 9 shows a sectional view according to section plane A—A of the substitute cover of FIG. 1.
Figure 10:
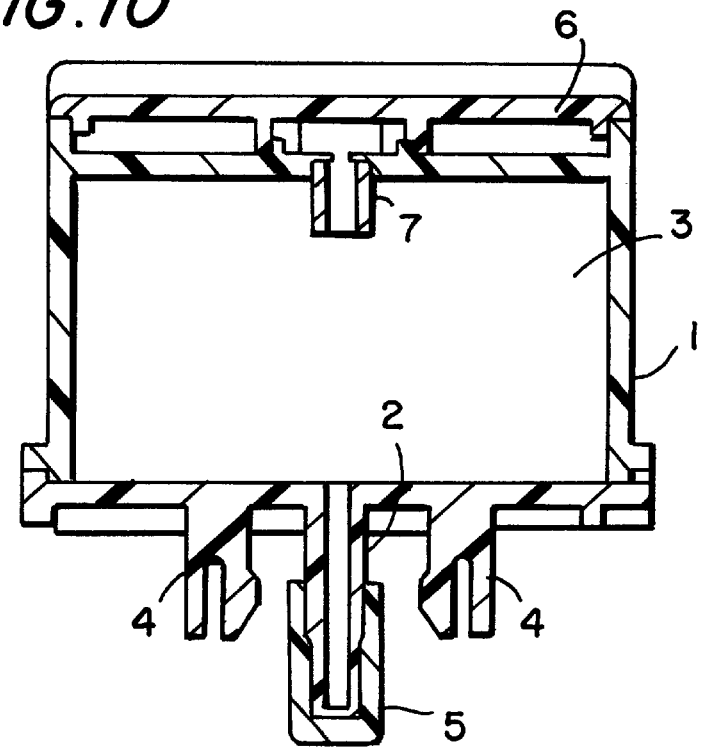
FIG. 10 shows a sectional view according to section plane B—B of the substitute cover of FIG. 1.

FIGS. 3 to 7 show orthogonal views of the substitute cover 10 of FIG. 1; there are shown:

the external shell 1 having the same size and shape as said original cover;

pierced pins 2, each of which is connected to one of the tanks 3 (positioned inside the external shell 1) containing an ink to be transferred into a relevant tank positioned inside the body 11 of the three-colour ink-jet writing head through the transfer means shown by FIGS. 9 to 11;

reversible means connecting the substitute cover 10 to the body 11. In the present embodiment the connecting means are realised through pairs of elastic fork-shaped elements 4 (omitted in the side view of FIG. 4) positioned beside one of the pierced pins 2 (FIGS. 5 to 7, 9 and 10) and suitable to be engaged in a reversible manner in the lateral holes 12 of the body 11 of the ink-jet writing head. The substitute cover 10 is therefore manually separable from the body 11 of the ink-jet writing head when at least one of its tanks 3 is empty.

Of course, a substitute cover 10 realised according to the invention and suitable for re-loading a one-colour ink-jet writing head is provided with only one pierced pin 2 belonging to the transfer means and connected to the sole tank 3 positioned inside the external shell 1.

Figure 8:
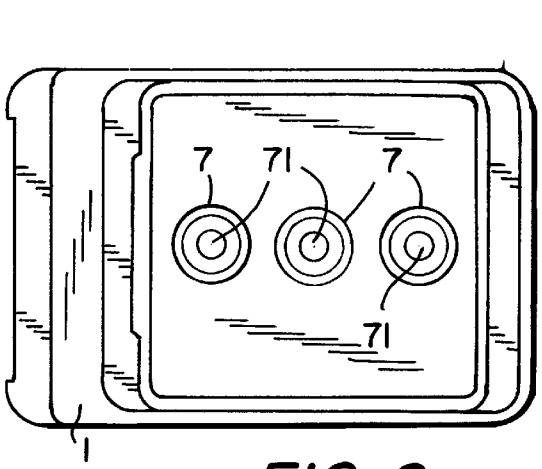
FIG. 8 shows a top view of the substitute cover of FIG. 1, without the upper layer 6 of FIG. 4.
Figure 3:
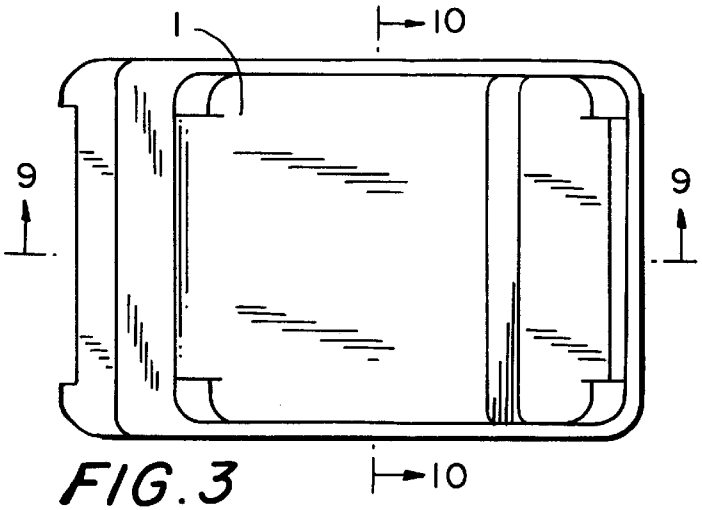
FIG. 3 shows a top view of the substitute cover of FIG. 1, whose sectional views according to section planes A—A and B—B are shown in FIGS. 9 and 10, respectively.
Figure 4:
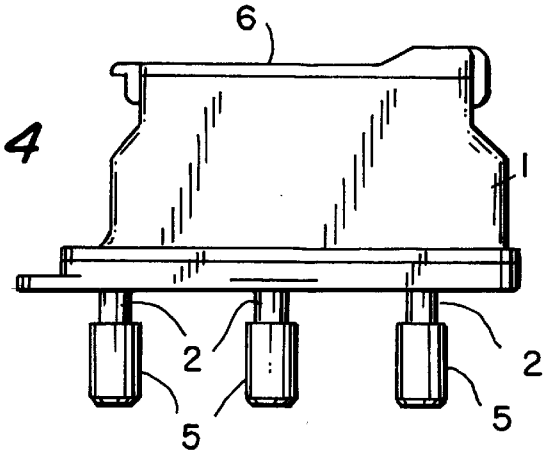
FIG. 4 shows a side view of the substitute cover of FIG. 1, without reversible connecting means.
Figure 5:
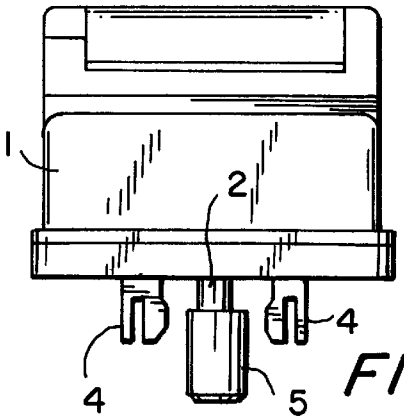
FIG. 5 shows a front view of the substitute cover of FIG. 1.
Figure 7:
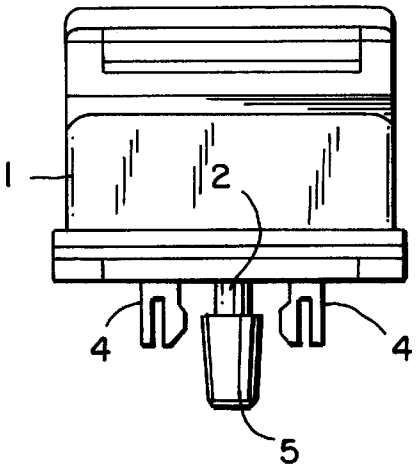
FIG. 7 shows a back view of the substitute cover of FIG. 1.
Figure 6:
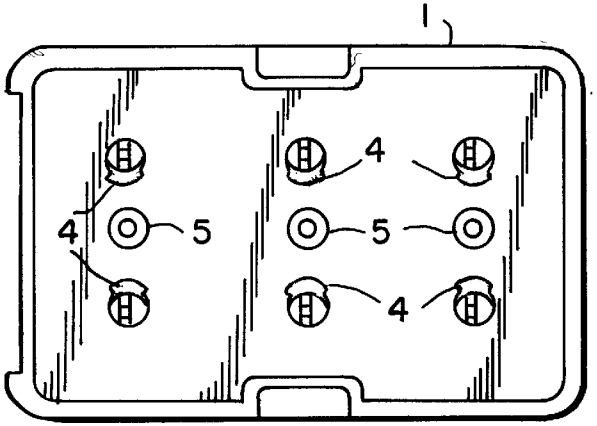
FIG. 6 shows a bottom view of the substitute cover of FIG. 1.

The pierced pins 2 are covered by protection caps 5, which must be removed before connecting the substitute cover 10 to the body 11 of the ink-jet writing head through the reversible connecting means. FIG. 8 shows a top view of the substitute cover 10 of FIG. 1 whose upper layer 6 (FIG. 4) has been removed to show the external holes 71 of valves 7 belonging to the transfer means: a preferred embodiment of a valve 7 is shown on the enlarged sectional view of FIG. 11. FIG. 9 shows a sectional view (according to section plane A—A of FIG. 3) of the substitute cover 10 of FIG. 1: there are shown, sectioned, the external shell 1 (including the upper layer 6) and three tanks 3 positioned inside the external shell 1, where each tank 3 is connected to transfer means including one of the above mentioned pierced pins 2 (covered with a protection cap 5) and one of the above mentioned valves 7, activated by the user for transferring the ink loaded into said tank 3 to the relevant tank positioned inside the body 11 of the three-colour ink-jet writing head.

FIG. 10 shows a sectional view (according to section plane B—B of FIG. 3) of the substitute cover 10 of FIG. 1; there are shown, sectioned, the external shell 1 including the upper layer 6, one of the tanks 3 positioned inside the external shell 1 (connected with a pierced pin 2 covered with a protection cap 5 and provided with a valve 7) and a pair of elastic fork-shaped elements 4 positioned beside the pierced pin 2.

According to a further possible embodiment, not shown in the figures, the substitute cover 10 includes an additional tank 3, positioned inside the external shell 1, which contains a black ink to be transferred to an additional tank positioned inside the body 11 of the ink-jet writing head through transfer means which includes an additional pierced pin 2 and an additional valve 7 activated by the user for transferring the black ink from the additional tank 3 positioned inside the external shell 1 to the additional tank positioned inside the body 11 of the ink-jet writing head.

FIG. 11 shows an enlarged view of a portion of FIG. 9 showing a preferred embodiment of the valve 7 (belonging to transfer means) positioned below the upper layer 6 of the external shell 1 of the substitute cover 10.

The valve 7 includes a cylindrical body 72 (having one end surrounding the external hole 71, the other end of reduced size and a circle of holes 73 on its lateral side) and a ball 74 pressure inserted inside the cylindrical body 72.

Figure 11A:
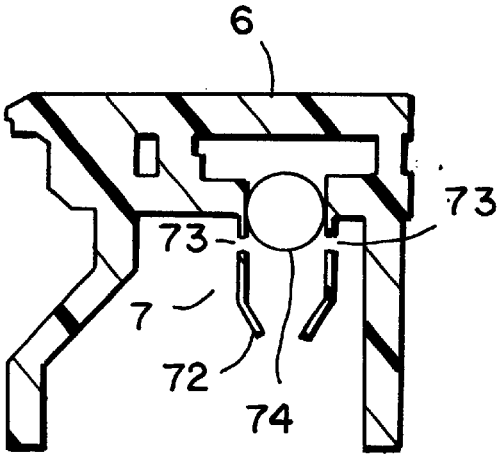
FIG. 11 shows an enlarged sectional view of a portion of FIG. 9 showing a preferred embodiment of a valve 7 belonging to the transfer means of the substitute cover of FIG. 1.
Figure 11B:
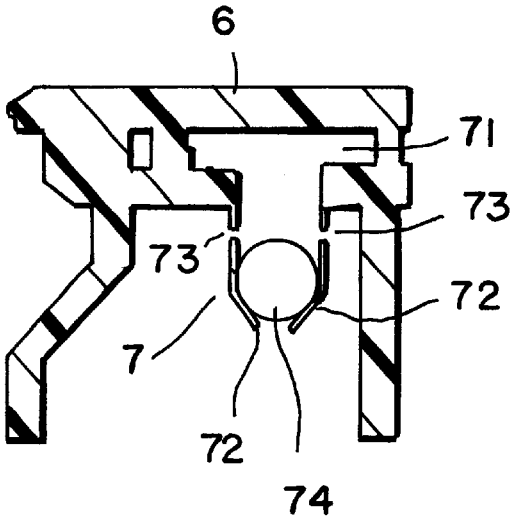

In the rest position of the valve 7 the external hole 71 is hermetically closed by the ball 74 as shown in FIG. 11*a*), while in the working position of the valve 7 the ball 74 is pushed down by the user [as shown in FIG. 11*b*)] through a pen, a pencil or another suitable means to transfer the ink from the tank 3 to the relevant tank positioned inside the body 11 of the ink-jet writing head.

When the ball 74 is pushed down, the external air enters tank 3 through the holes 73 and, as a consequence, the ink goes down by gravity from tank 3 to the relevant tank positioned inside the body 11 of the ink-jet writing head through the relevant pierced pin 2 inserted into the relevant central hole 13 provided in the upper side of the body 11 of the ink-jet writing head.

Figures 12, 13:
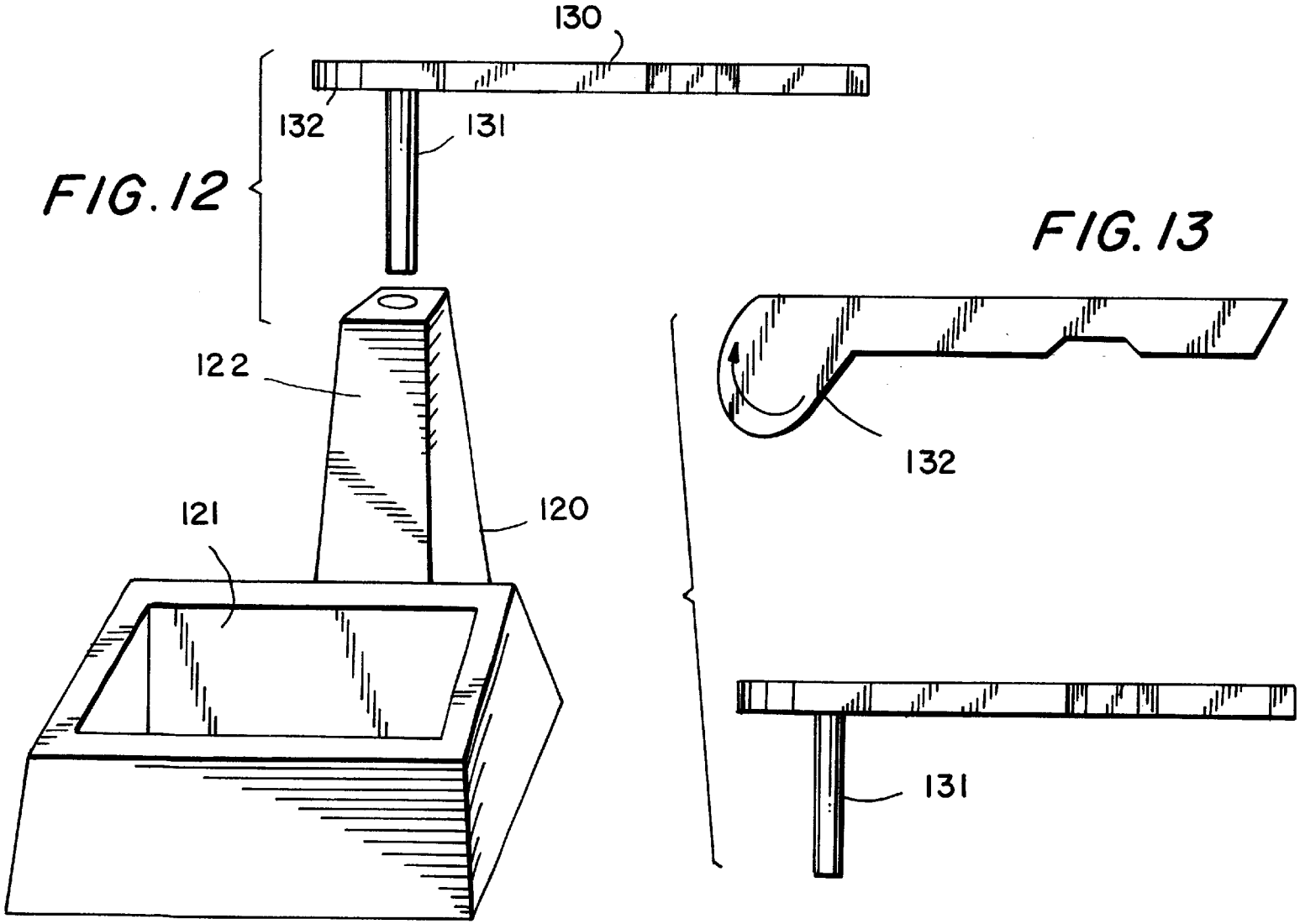
FIG. 12 shows a mechanical device, realised according to the invention, for removing the original cover from the body of an ink-jet writing head.
FIG. 13 shows a top view and a side view of the leverage 130 of FIG. 12.

FIG. 12 shows a mechanical device realised according to the invention for removing the original cover from the body 11 of an ink-jet writing head: it comprises a base 120 suitable for receiving at least partially the body 11 of the ink-jet writing head and a leverage 130, "pivotally" connected to the base 120, acting on the connection zone between the original cover and the body 11 of the ink-jet writing head at least partially positioned inside the base 120. FIG. 13 shows the top and side views of the leverage 130.

The base 120 includes a cavity 121 suitable for receiving the lower part of the body 11 of the ink-jet writing head and a pierced section 122 wherein a pin 131, connected to a cam-shaped end 132 of the leverage 130 (FIG. 13), is "pivotally" inserted: the pierced section 122 of the base 120 is so high that the cam-shaped end 132 of the leverage 130 is acting on the connection zone between the original cover and the body 11 of the ink-jet writing head when it is partially positioned into the cavity 121 of the base 120.

The use of the re-loading device object of the present invention is now briefly described.

Partially positioned the ink-jet writing head into the cavity 121 of the base 120, the original cover used by the producer is removed from the body 11 of the ink-jet writing head by acting through the cam-shaped end 132 of the leverage 130 on the connection zone between the original cover and the body 11 of the ink-jet writing head.

A substitute cover 10 is then connected to the body 11 of the ink-jet writing head through reversible connecting means: the pierced pins 2 are inserted into the relevant loading holes 13 provided in the upper side of the body 11 of the ink-jet writing head, connecting the tanks 3 positioned inside the external shell of the substitute cover 10 to the relevant tanks positioned inside the body 11 of the ink-jet writing head.

When one of the tanks positioned inside the body 11 of the ink-jet writing head is empty, the user removes the upper layer 6 of the substitute cover 10 and pushes down the ball 74 of the valve 7 of the tank 3 of the substitute cover 10 where the ink to be transferred is loaded: the external air enters tank 3 through the holes 73 provided on the lateral side of the cylindrical body 72 of the valve 7 and the ink goes down by gravity from the tank 3 of the substitute cover 10 to the relevant tank positioned inside the body 11 of the ink-jet writing head, re-loading them.

Of course, two or more of the tanks positioned inside the body 11 of the ink-jet writing head can be re-loaded at the same time by pushing down the balls 74 of the valves 7 of the relevant tanks 3 positioned inside the substitute cover 10.

Afterward, the user separates manually the substitute cover 10 including at least one empty tank 3 and connects to the body 11 of the ink-jet writing head another substitute cover 10.

What is claimed is:

1. A re-loading device for ink-jet writing head, comprising a mechanical device for removing from the body of said ink-jet writing head the original cover used by the producer and a substitute cover which is connected to said body of said ink-jet writing head in place of said original cover, wherein:

(i) said mechanical device comprises a base suitable for receiving at least a part of said body of said ink-jet writing head and a leverage pivotally connected to said base and acting on the connection zone between said original cover and said body of said ink-jet writing head at least partially positioned into said base; and:

(ii) said substitute cover has the same size and shape as the original cover and includes:

an external shell having the same size and shape as said original cover;

at least one tank, positioned inside said external shell of said substitute cover;

transfer means for transferring ink from said at least one tank positioned inside said external shell to at least one relevant tank positioned inside said body of said ink-jet writing head;

reversible means for connecting said substitute cover to said body of said ink-jet writing head, said substitute cover being manually separable from said body of said ink-jet writing head when at least one tank of said substitute cover is empty.

2. A re-loading device according to claim 1, wherein said base includes a cavity suitable for receiving at least a part of said body of said ink-jet writing head and a pierced section wherein a pin belonging to said leverage is pivotally inserted, said pierced section of said base being so high that said leverage is acting on said connection zone between said original cover and said body of said ink-jet writing head partially positioned into said cavity of said base.

3. A re-loading device according to claim 2, wherein said pin is connected to a cam-shaped end of said leverage which acts on said connection zone between said original cover and said body of said ink-jet writing head.

4. A re-loading device according to claim 1 wherein inside said external shell of said substitute cover a plurality tanks are positioned, each of said tanks containing one of the inks to be transferred into a relevant tank positioned inside said body of said ink-jet writing head through said transfer means.

5. A re-loading device according to claim 1, wherein said reversible connecting means includes pairs of elastic fork-shaped elements positioned beside pierced pins belonging to said transfer means and suitable to be engaged in a reversible manner in relevant pairs of holes provided in said upper side of said body of said ink-jet writing head.

6. A re-loading device according to claim 1, wherein said transfer means includes, a pierced pin connected to said tank of said substitute cover and a valve, activated by the user for transferring said ink from said tank positioned inside said external shell to said relevant tank positioned inside said body of said ink-jet writing head.

7. A re-loading device according to claim 6, wherein said valve includes a cylindrical body having a first end surrounding an external hole provided in the upper side of said substitute cove, a second end of reduced size and a circle of holes on its lateral side, and a ball which is pressure inserted inside said cylindrical body.

8. A re-loading device according to claim 7, wherein at the rest position of said valve said ball closes hermetically said external hole.

9. A re-loading device according to claim 7, wherein at the working position of said valve said ball is pushed down by the user, the external air enters said tank positioned inside said external shell through said holes on the lateral side of said cylindrical body of said valve and said ink goes down by gravity from said tank positioned inside said external shell to said relevant tank positioned inside said body of said ink-jet writing head through said pierced pin inserted into a relevant loading hole provided in the upper side of said body of said ink-jet writing head.

10. A re-loading device according to claim 6, wherein said pierced pin is provided with a protection cap to be removed before connecting said substitute cover to said body of said ink-jet writing head.

* * * * *